United States Patent [19]

Herman

[11] 4,170,239

[45] Oct. 9, 1979

[54] CIGARETTE HOLDER

[76] Inventor: John Herman, 3060 Belden Dr., Los Angeles, Calif. 90068

[21] Appl. No.: 898,395

[22] Filed: Apr. 20, 1978

[51] Int. Cl.[2] ..... A24F 13/22

[52] U.S. Cl. ..... 131/257; 24/84 R; 24/81 CC

[58] Field of Search ..... 131/257, 259, 260; 24/84 R, 81 CC, 81 KF, 31 C

[56] References Cited

U.S. PATENT DOCUMENTS

| | | | |
|---|---|---|---|
| D. 242,931 | 1/1977 | Kaiser et al. | 131/257 X |
| 252,753 | 1/1882 | Fitzgerald | 131/257 |
| 2,800,909 | 7/1957 | Schlatterer | 131/257 X |

FOREIGN PATENT DOCUMENTS

| | | | |
|---|---|---|---|
| 3950 | of 1883 | United Kingdom | 131/259 |

*Primary Examiner*—Stephen C. Pellegrino
*Attorney, Agent, or Firm*—George J. Netter

[57] ABSTRACT

There is provided a cigarette holder having the overall appearance of a key, such as an ignition key for an automobile, for example, which is manipulated by the fingers to grip a cigarette for use during smoking. The key-shaped cigarette holder includes a clip at the end opposite the cigarette gripping part which is simultaneously operated for selective connection and removal from a key ring.

3 Claims, 5 Drawing Figures

CIGARETTE HOLDER

The present invention pertains generally to a cigarette holder construction, and, more particularly, to such a cigarette holder construction which is adaptable for being carried on a key ring.

SUMMARY OF THE INVENTION

In the practice of this invention there is provided a cigarette holder having the overall appearance of a key, such as an ignition key for an automobile, for exampe, which is manipulated by the fingers to grip a cigarette for use during smoking. In addition, the key-shaped cigarette holder includes clip means at the end opposite the cigarette gripping part which is simultaneously operated for selective connection and removal from a key ring.

DESCRIPTION OF A PREFERRED EMBODIMENT

Figure 1:
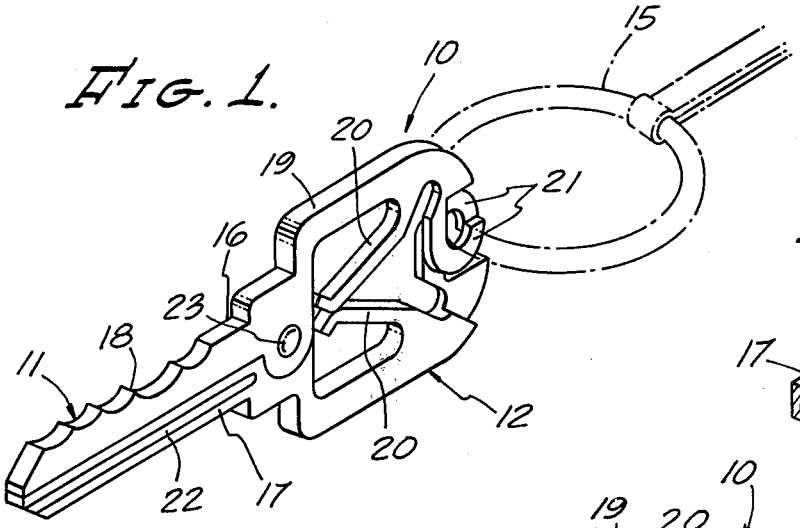
FIG. 1 is a perspective view of the cigarette holder of this invention, shown attached to a key ring.
Figure 5:
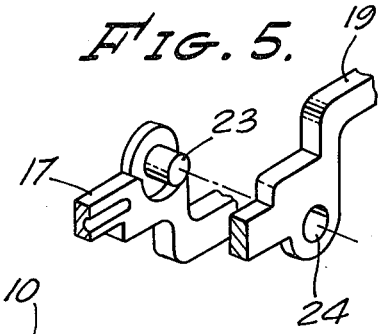
FIG. 5 is an exploded fragmentary view of parts of the cigarette holder prior to assembly.
Figure 4:
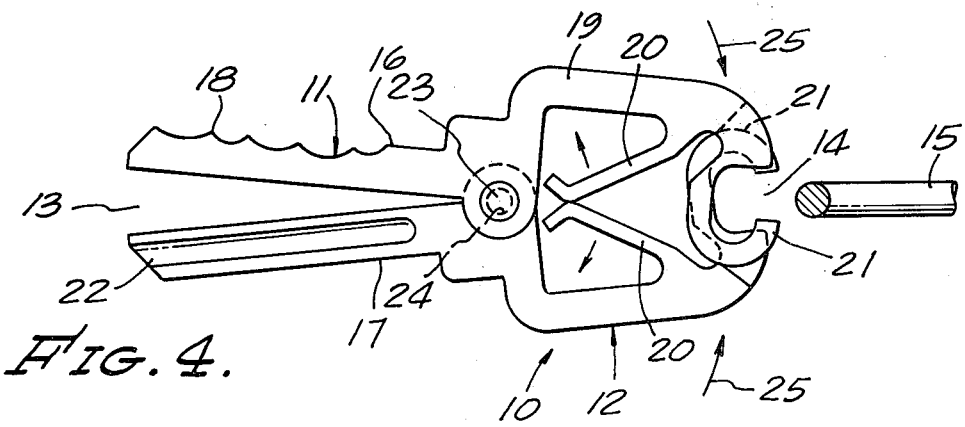
FIG. 4 is an elevational view similar to FIG. 2, showing the cigarette holder in open condition.

With referenc now to the drawing and particularly to FIGS. 1 and 4, the cigarette holder of this invention is enumerated generally as at 10 and is seen to have the overall appearance of an ignition key for an automotive vehicle. More particularly, the cigarette holder has a serrated shank 11 and a head portion 12. As will be more particularly described and as best shown in FIG. 4, when finger force is applied to the head portion 12 of the cigarette holder in the directions of the arrows, the outer end of the shank separates as at 13, providing a cigarette gripping portion. At the same time the head portion also opens to provide an opening 14, permitting receipt of a key ring 15, for example, therewithin. When the finger force is removed from the key, the resilient spring force of the various parts causes the device to once again assume the appearance of FIG. 1, with the head secured onto the key ring 15, or, in the event of smoking, the gripping portion 13 clipped onto a cigarette.

As to detailed construction, the cigarette holder 10 comprises two coacting parts or halves 16 and 17. The part 16 includes an elongated serrated shank 18, integrally connected with a head portion 19, a spring bar 20 and a hooklike C-shaped member 21 at the head end. The companion holder part or half 17 has an elongated shank having a longitudinal groove 22, as is found in conventional keys and a head portion substantially indentical to that of part 16. The two parts 16 and 17 are preferably constructed from a flat metal sheet and are rotatably assembled together via a pin 23 on the part 17, which passes through an opening 24 in part 16. The pin 23 and opening 24 are each located in the region lying between the shank and head. The body material surrounding the pin 23 and the opening 24 is removed so that when the parts are assembled together, the two shank parts and the head parts lie in the same plane, namely, the plane of pivoting.

The spring bars 20 are elongated elements which extend away from the head and angularly back toward the shank. When in assembled condition the inner ends of the spring bars contact each other, forming a general V-shape. These bars resiliently engage one another, exerting a force resisting movement of the head parts toward one another and urging them apart.

Figure 2:
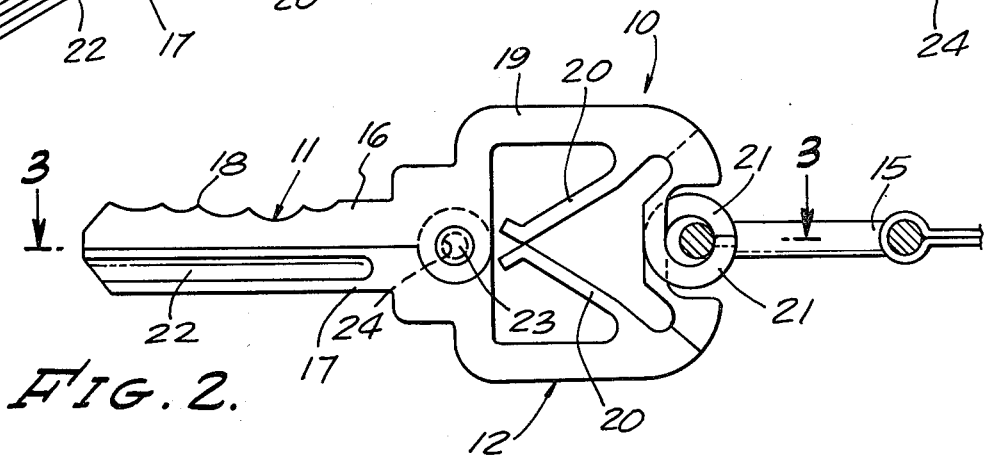
FIG. 2. is a side elevational view of the cigarette holder in FIG. 1 shown in closed position.
Figure 3:
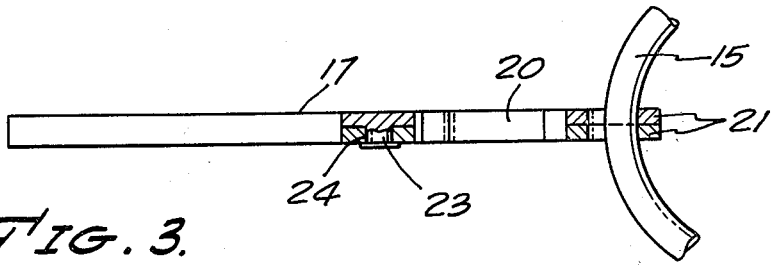
FIG. 3 is a plan, sectional view taken along the line 3—3 of FIG. 2.

The C-shaped member 21 of each holder part opens back toward itself and is so-dimensioned as to overlie the other when assembled (FIG. 2). Also, as can be appreciated by comparing FIGS. 2 and 3, the thickness of the body metal forming the C-shaped members has been substantially reduced so that when in overlying relation, the total thickness is about the same as that of the remainder of the parts.

It is contemplated in assembly that when the two parts are joined together with the pin 23 passing through the opening 24, that the outer end thereof will be peened over to prevent removal of the parts one from the other and yet allow pivoting about the pin. As an alternative, the pin may be substituted for by a rivet which passes through openings in both holder parts and is secured in the conventional manner.

In use of the described invention, depression by the fingers in the direction of the arrows 25 as shown in FIG. 4 exerts a force on the two spring bars, causing them to move away from each other somewhat and to be compressed. Continuing the pinching force causes shank parts 16 and 17 to separate and form the cigarette gripping portion 13. Also, at the same time, the C-shaped members separate to provide the opening 14, via which the holder may be attached or removed from a key ring. On release of the device, the springlike action of the bars returns the holder to its closed position as in FIGS. 1 and 2.

Although other materials may be found useful in fabricating the subject invention, it has been found in a practical construction of this invention that the parts made by stamping them from sheet brass are excellent in appearance and operation. Brass not only has the conventional appearance of many types of ignition keys, but also it has the suitable rigidity and strength to meet requirements of use and, still further, has the spring-like qualities which make it operate in a manner for holding the closed position when at rest and to provide the gripping jaws and opening for attachment to a key ring, when compressed.

What is claimed is:

1. A cigarette holder, comprising:

first and second metal members, each having a shank and a head portion, said members being arranged in overlying relation with the shanks of each contacting the other;

a pivot pin interrelating said metal members for rotative movement thereabout;

springlike means integral with the head portions continuously urging the head portions away from each other and the shank portions toward each other; and said head portions having respective generally C-shaped members overlying one another to form an attachment opening;

said C-shaped members and the shanks respectively moving away from each other when the head portions are forced toward each other, whereby the so formed space between the shanks provides means for gripping a cigarette and the space between the C-shaped members provides means for attachment of the holder to an external means.

2. A cigarette holder as in claim 1, in which the springlike means include a barlike member extending from each of said head portions, the end portions of which barlike members are in continuous contact.

3. A cigarette holder as in either of claims 1 or 2, in which the metal members are constructed from sheet metal and the pivot pin is integrally formed in one of said members.

* * * * *